US010604968B2

(12) United States Patent
Smith

(10) Patent No.: US 10,604,968 B2
(45) Date of Patent: Mar. 31, 2020

(54) LOCK ASSEMBLY FOR SECURING A STORAGE CONTAINER

(71) Applicant: COMMANDO LOCK COMPANY, LLC, Troy, MI (US)

(72) Inventor: Patrick Smith, Troy, MI (US)

(73) Assignee: COMMANDO LOCK COMPANY, LLC, Troy, MI (US)

( * ) Notice: Subject to any disclaimer, the term of this patent is extended or adjusted under 35 U.S.C. 154(b) by 0 days.

(21) Appl. No.: 16/597,997

(22) Filed: Oct. 10, 2019

(65) Prior Publication Data

US 2020/0040612 A1 Feb. 6, 2020

Related U.S. Application Data

(63) Continuation of application No. 15/891,568, filed on Feb. 8, 2018.

(60) Provisional application No. 62/456,927, filed on Feb. 9, 2017.

(51) Int. Cl.

| | |
|---|---|
| ***E05B 67/00*** | (2006.01) |
| ***E05B 35/00*** | (2006.01) |
| ***E05B 73/00*** | (2006.01) |
| ***E05C 21/00*** | (2006.01) |

(52) U.S. Cl.

CPC ..... *E05B 67/003* (2013.01); *E05B 35/00* (2013.01); *E05B 73/0005* (2013.01); *E05C 21/00* (2013.01)

(58) Field of Classification Search

CPC .... E05B 67/003; E05B 35/00; E05B 73/0005; E05C 21/00

USPC .... 70/2, 6, 158–173, 14, 18, 30, 49, 53, 68, 70/69, 76, DIG. 63, 63, 58–61, 64, 51; 109/45, 50–52

See application file for complete search history.

(56) References Cited

U.S. PATENT DOCUMENTS

| | | | | |
|---|---|---|---|---|
| 1,538,033 A | | 5/1925 | Fraim | |
| 4,488,624 A | * | 12/1984 | Myers | A45C 3/00 190/120 |
| 4,573,332 A | | 3/1986 | Ma | |
| 5,174,136 A | | 12/1992 | Thwing | |
| 5,365,757 A | | 11/1994 | Primeau | |
| 5,531,083 A | * | 7/1996 | Franck, III | E05B 73/0005 70/49 |
| 5,595,073 A | * | 1/1997 | Sullivan | E05B 17/002 70/159 |
| 5,768,920 A | * | 6/1998 | DeBevoise | E05B 73/0005 70/18 |
| 6,349,575 B1 | * | 2/2002 | Bentley | E05B 73/0005 70/14 |
| 6,516,644 B1 | | 2/2003 | Seliber | |
| 6,604,390 B1 | | 8/2003 | Nooner | |
| 6,843,080 B1 | | 1/2005 | Yu | |

(Continued)

*Primary Examiner* — Lloyd A Gall

(74) *Attorney, Agent, or Firm* — Carlson, Gaskey & Olds

(57) ABSTRACT

The method comprises a technique for securing a storage container to a fixed structure or object. The steps include providing a container having a compartment for storage and a lid for covering the container. The container is located near the fixed structure, such as a truck bed. The container is secured to the structure with a first lock having a first lock body and a cable by using a key. The lid of the container is secured to the container using a second lock, the second lock having a second lock body and a shackle. Though the two locks are different, they each use the same key to lock and unlock each lock.

5 Claims, 3 Drawing Sheets

(56) References Cited

U.S. PATENT DOCUMENTS

| | | | |
|---|---|---|---|
| 7,194,877 | B1 | 3/2007 | Cottrell |
| 7,246,511 | B1 | 7/2007 | Zhu |
| 7,757,523 | B1 | 7/2010 | Garcia et al. |
| 8,068,027 | B2 | 11/2011 | Auerbach et al. |
| 8,910,498 | B2 | 12/2014 | Saucier et al. |
| 9,115,513 | B1 | 8/2015 | Cayouette |
| 9,879,447 | B2 | 1/2018 | Tropp |
| 2002/0148395 | A1 | 10/2002 | Judge |
| 2009/0183535 | A1 | 7/2009 | Darville |
| 2015/0082840 | A1 | 3/2015 | Trinh et al. |

* cited by examiner

LOCK ASSEMBLY FOR SECURING A STORAGE CONTAINER

CROSS-REFERENCE TO RELATED APPLICATION

This application is a continuation of U.S. patent application Ser. No. 15/891,568, filed on Feb. 8, 2018, which claims priority to U.S. Provisional Application No. 62/456,927, filed on Feb. 9, 2017.

BACKGROUND

This disclosure relates to a lock assembly for securing a storage container, such as cooler for beverages or a storage container unit for tools.

Portable storage containers are frequently used for recreation and for work. These containers such as toolboxes, coolers, footlockers and other transportable boxes may have a latch, which may be locked to secure their lid against unauthorized access. Because these storage containers themselves are portable, they may also need to be secured against theft by locking them to a stationary object. For example, a toolbox may be secured to the bed of a pickup truck by a cable lock. In addition, a cooler may likewise be secured by cable to a picnic table.

SUMMARY

The inventive method comprises a technique for securing a storage container to a fixed structure or object. The steps include providing a container having a compartment for storage and a lid for covering the container. The container is located near the fixed structure, such as a truck bed. The container is secured to the structure with a first lock having a first lock body and a cable by using a key. The lid of the container is secured to the container using a second lock, the second lock having a second lock body and a shackle. Though the two locks are different, they each use the same key to lock and unlock each lock.

In a further non-limiting embodiment of the foregoing method, the cable is threaded through the container at a first opening and the shackle is threaded through the container at a second opening. The first opening is spaced from the second opening.

In a further non-limiting embodiment of the foregoing method, the first opening is an opening of a handle and the second opening is an opening through the lid.

In a further non-limiting embodiment of the foregoing method, the first lock has a first locked condition and a first unlocked condition and the second lock has a second locked condition and a second unlocked condition. The same key changes the first lock between the first locked condition and the first unlocked condition and the second lock between the second locked condition and the second unlocked condition.

The embodiments, examples and alternatives of the preceding paragraphs, the claims, or the following description and drawings, including any of their various aspects or respective individual features, may be taken independently or in any combination. Features described in connection with one embodiment are applicable to all embodiments, unless such features are incompatible.

The various features and advantages of this disclosure will become apparent to those skilled in the art from the following detailed description. The drawings that accompany the detailed description can be briefly described as follows.

BRIEF DESCRIPTION OF THE DRAWINGS

The various features and advantages of this disclosure will become apparent to those skilled in the art from the following detailed description. The drawings that accompany the detailed description can be briefly described as follows.

DETAILED DESCRIPTION

Figure 1:
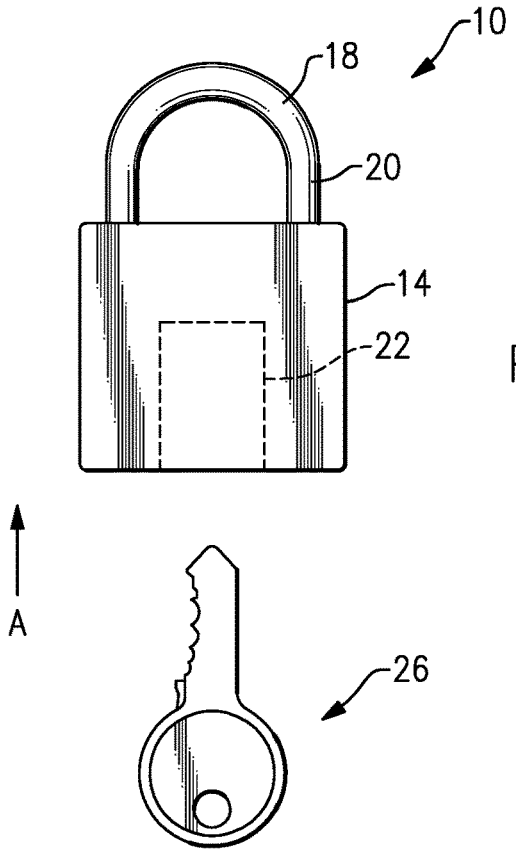
FIG.1 Prior Art
FIG. 1 schematically illustrates a lock assembly in a locked condition.
Figure 2:
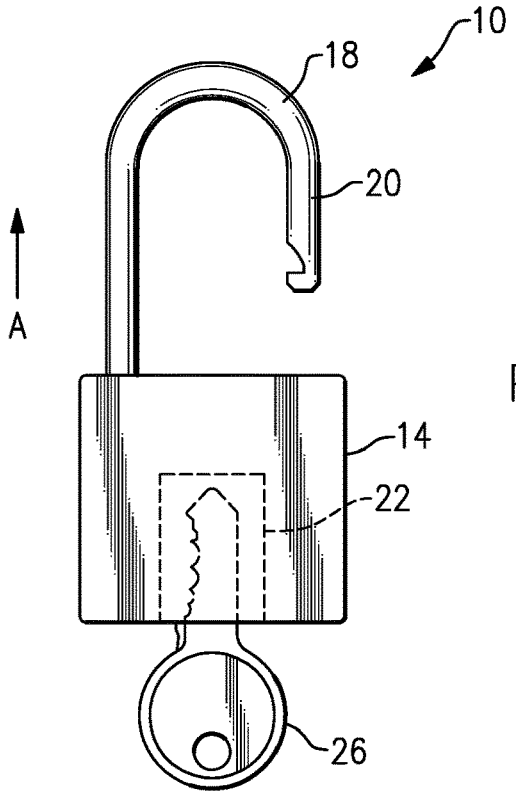
FIG.2 Prior Art
FIG. 2 schematically illustrates the lock assembly of FIG. 1 in an unlocked condition.

This disclosure relates to an inventive lock assembly. FIGS. 1 and 2 show a prior art lock comprising first lock 10 with first lock body 14 and shackle 18. As known, first lock 10 has first locked condition wherein shackle 18 is locked to first lock body 14 as shown in FIG. 1. As shown in FIG. 2, first lock 10 also has first unlocked condition wherein shackle 18 is unlocked from first lock body 14. Here, leg 20 of shackle 28 is freed from first lock body 14 when unlocked as shown and as known. First lock 10 further has key receptacle 22, here a key cylinder, which, upon insertion of key 26 into key receptacle 22 controls the locked and unlocked condition of first lock 10, altering, changing or moving first lock 10 between first locked condition (FIG. 1) and first unlocked condition (FIG. 2). Although key receptacle 22 is shown here as a key cylinder, key receptacle 22 can be any known shape.

Figure 3:
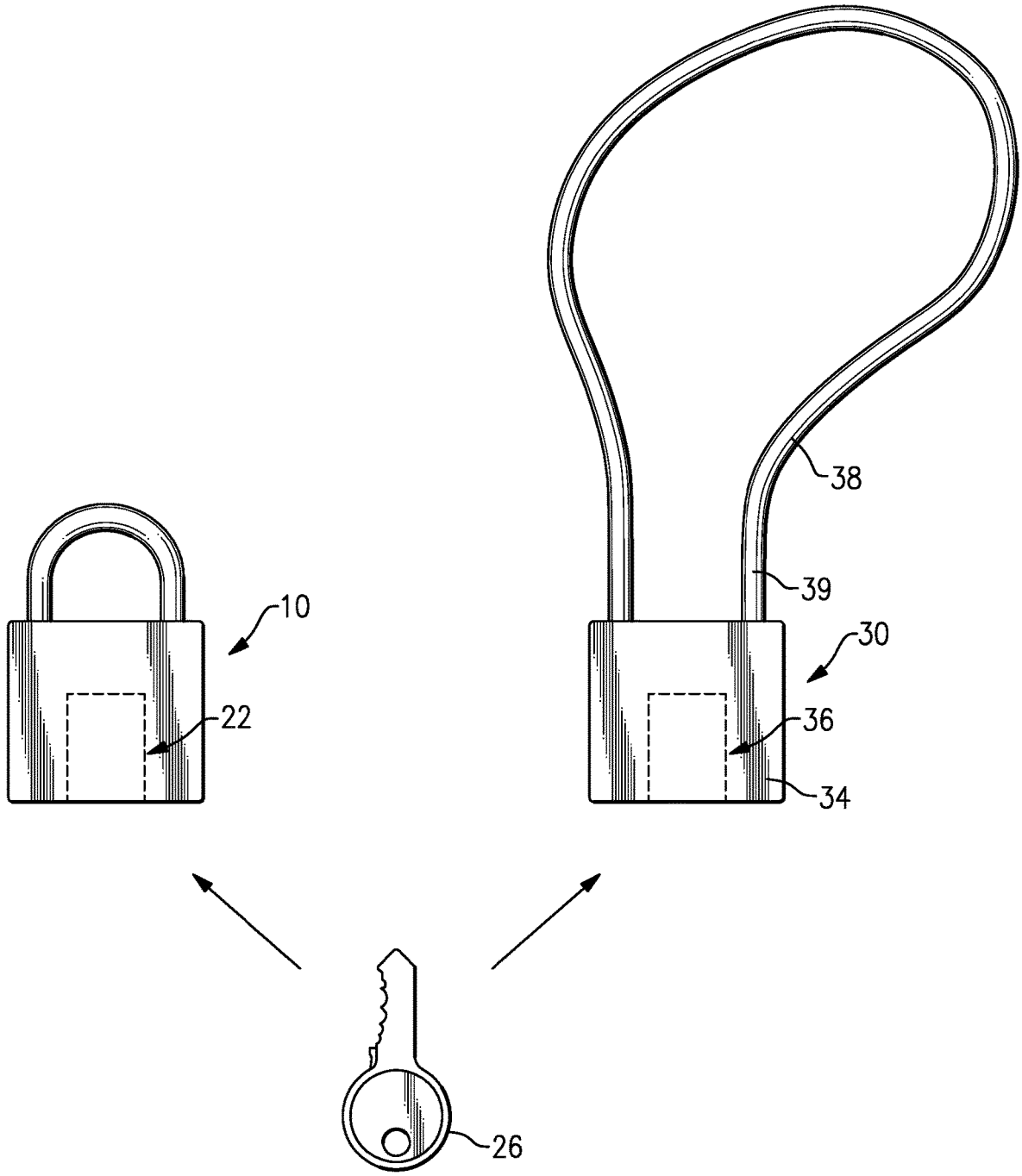
FIG. 3 illustrates the inventive lock assembly for securing a storage container, showing the lock of FIG. 1 with a second lock.

With reference to FIG. 3, first lock 10 is shown together with second lock 30. Second lock 30 has second lock body 34 and cable 38. Here, second lock 30 is shown in second locked condition. Second lock 30 also has second unlocked condition wherein a leg of cable 38, here leg 39, is unlocked from second lock body 34 like the condition of first lock 10 shown in FIG. 2. Second lock 30 has second key receptacle 36 for actuating second lock 30 between second locked condition and second unlocked condition.

In contrast to existing locking systems, first lock 10, a shackle lock, is paired with second lock 30, a cable lock, so that first key receptacle 22 and second key receptacle 36 can accept and are keyed to the same key, key 26, so as to permit both first lock 10 and second lock 30 to be locked and unlocked by key 26. That is, key 26 controls the actuation of first lock 10 between first locked condition and first unlocked condition and likewise controls the actuation of second lock 30 between second locked condition and second unlocked condition. In this way, the inventive lock assembly provides both the flexibility of a shackle lock and a cable lock while offering the convenience of a single key to control locking and unlocking of both locks. Both first lock 10 and second lock 30 can be sold together, including in the same package, with key 26 thereby offering consumers the benefits of the invention in a single package.

Figure 4:
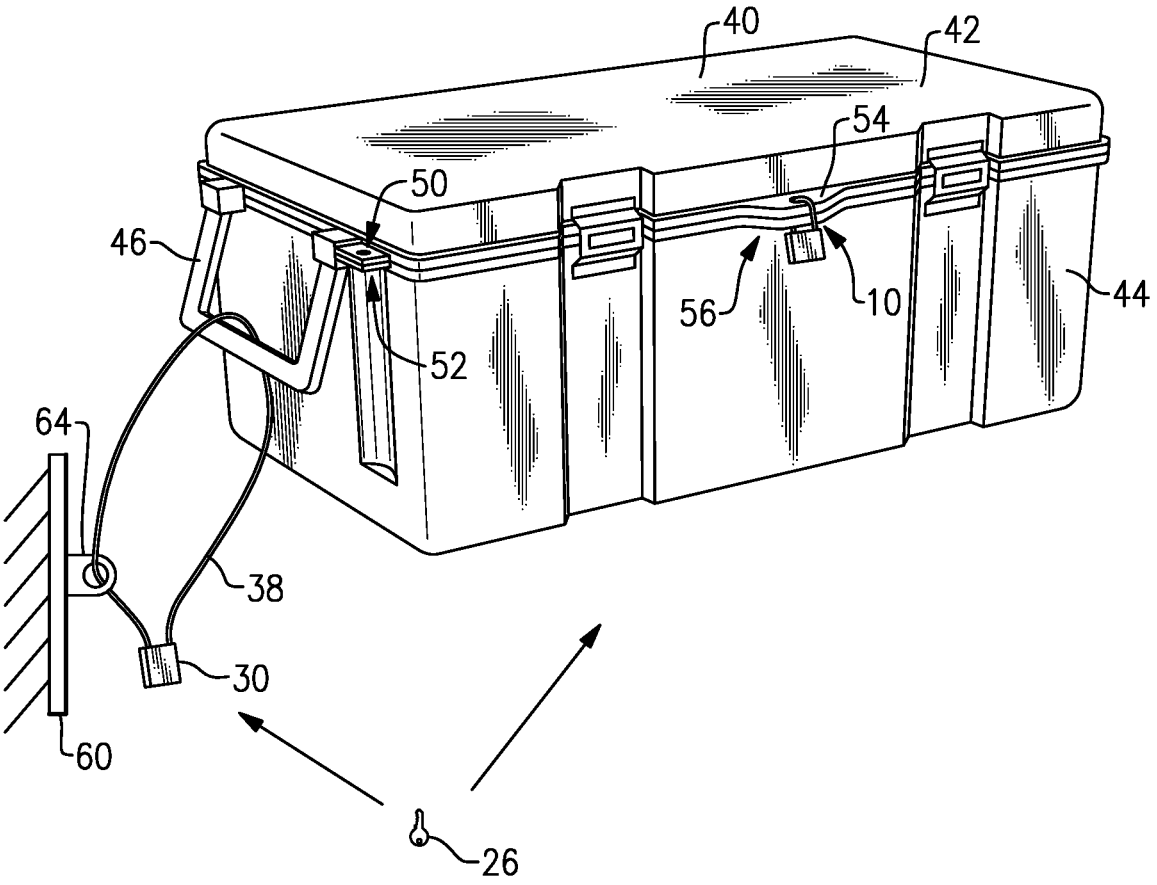
FIG. 4 illustrates the inventive lock assembly used to secure a storage container.

This inventive lock assembly is particularly useful for securing storage containers. FIG. 4 shows storage container 40 having lid 42, compartment 44 and handle 46. Storage container 40 further has securing holes that help secure lid 42 to compartment 44 to prevent access to the contents of compartment 44. Here, securing holes are shown by first securing hole 50, located in a flange of lid 42, and second securing hole 52, located in a flange of compartment 44. First securing hole 50 and second securing hole 52 are sized to receive either shackle 18 of first lock 10 or cable 38. By threading shackle 18 through first securing hole 50 and second securing hole 52 and locking first lock 10, lid 42 is secured to compartment 44 to prevent access to compartment 44.

Additionally, lid 42 can be provided with third securing hole 54, part of a flange of lid 42, while compartment 44 can have a flange with fourth securing hole 56. Both holes are sized to receive shackle 18 or cable 38. Lid 42 and compartment 44 can be locked closed to prevent unauthorized access to the contents of compartment 44 by threading shackle 18 through third securing hole 54 and fourth securing hole 56 and locking first lock 10. In lieu of securing holes, latches may be used to secure lid 42 to compartment 44.

While the foregoing may lock lid 42 to compartment 44, there is a further need to secure storage container 40 because of its portable nature. Here, second lock 30, a cable lock, serves this function. As shown in FIG. 4, cable 38 is threaded to handle 46, which is part of compartment 44. There is also securing structure 60, a fixed object, which may be a bed of a truck, a building, a picnic table, or any other relatively fixed structure. Securing structure 60 has fifth securing hole 64, which is large enough for cable 38 to be threaded through. In this way, when second lock 30 is in the second unlocked condition, cable 38 can be threaded through handle 46 and fifth securing hole 64, and then second lock 30 placed in second locked condition to thereby secure storage container 40 against movement and theft. Hence, first lock 10 can secure lid 42 to compartment 44, thereby preventing the opening of storage container 40. Further, storage container 40 can be restricted to a proximate location near securing structure 60. Further, both first lock 10 and second lock 30 can then be locked and unlocked using the same key, here key 26.

The foregoing description shall be interpreted as illustrative and not in any limiting sense. A worker of ordinary skill in the art would understand that certain modifications could come within the scope of this disclosure. For these reasons, the following claims should be studied to determine the true scope and content of this disclosure.

What is claimed is:

1. A method of securing a storage container, comprising the steps of:

providing a container having a compartment for storage and a lid for covering the container;

locating the container near a structure fixed in position relative to the container;

securing the container to the structure with a first lock having a first lock body and a cable by using a key; and securing the lid to the container using a second lock having a second lock body and a shackle by using the same key.

2. The method of claim 1 wherein the cable is threaded through the container at a first opening and the shackle is threaded through the container at a second opening, the first opening spaced from the second opening.

3. The method of claim 2 wherein the first opening is an opening of a handle and the second opening is an opening through the lid.

4. The method of claim 1 wherein the first lock has a first locked condition and a first unlocked condition and the second lock has a second locked condition and a second unlocked condition, wherein the same key changes the first lock between the first locked condition and the first unlocked condition and the second lock between the second locked condition and the second unlocked condition.

5. The method of claim 1 wherein the structure is a truck bed.

* * * * *